US009121228B2

(12) United States Patent
Prescott

(10) Patent No.: US 9,121,228 B2
(45) Date of Patent: Sep. 1, 2015

(54) HYBRID BUOYED AND STAYED TOWERS AND RISERS FOR DEEPWATER

(75) Inventor: Clifford Neal Prescott, Houston, TX (US)

(73) Assignee: FLUOR TECHNOLOGIES CORPORATION, Aliso Viejo, CA (US)

( * ) Notice: Subject to any disclaimer, the term of this patent is extended or adjusted under 35 U.S.C. 154(b) by 587 days.

(21) Appl. No.: 13/503,008

(22) PCT Filed: Oct. 20, 2010

(86) PCT No.: PCT/US2010/053380
§ 371 (c)(1), (2), (4) Date: Aug. 9, 2012

(87) PCT Pub. No.: WO2011/050064
PCT Pub. Date: Apr. 28, 2011

(65) Prior Publication Data

US 2012/0292040 A1 Nov. 22, 2012

Related U.S. Application Data

(60) Provisional application No. 61/253,765, filed on Oct. 21, 2009.

(51) Int. Cl.
*E21B 17/01* (2006.01)
*E21B 23/00* (2006.01)

(52) U.S. Cl.
CPC ..... *E21B 17/01* (2013.01); *E21B 17/012* (2013.01); *E21B 17/015* (2013.01)

(58) Field of Classification Search
CPC ..... E21B 17/01; E21B 17/012; E21B 17/015
USPC ..... 405/224.2, 224.3, 224.4; 166/350, 351, 166/352, 367
See application file for complete search history.

(56) References Cited

U.S. PATENT DOCUMENTS

| | | | |
|---|---|---|---|
| 3,913,668 | A | 10/1975 | Todd et al. |
| 4,119,145 | A | 10/1978 | Tuson |
| 4,332,509 | A | 6/1982 | Reynard et al. |
| 4,401,164 | A | 8/1983 | Baugh |
| 4,941,773 | A | 7/1990 | Vergouw |
| 4,963,420 | A | 10/1990 | Jarrin et al. |

(Continued)

FOREIGN PATENT DOCUMENTS

| | | |
|---|---|---|
| WO | 01/14687 | 3/2001 |
| WO | 02/063128 | 8/2002 |

(Continued)

OTHER PUBLICATIONS

"International Search Report and the Written Opinion of the International Searching Authority", Patent Cooperation Treaty, Dec. 22, 2010.

*Primary Examiner* — James G Sayre
(74) *Attorney, Agent, or Firm* — Fish & Tsang, LLP

(57) ABSTRACT

Contemplated hybrid riser towers are configured such that individual riser lines can be added or removed via submarine ROV. Most preferably, riser lines are made from a housing and syntactic foam that encloses a riser pipe to so provide insulation and buoyancy. In further preferred aspects, hybrid riser towers are coupled to each other via a truss to allow expansion via SCR and/or to provide a riser porch.

15 Claims, 5 Drawing Sheets

(56) References Cited

U.S. PATENT DOCUMENTS

| | | | | |
|---|---|---|---|---|
| 5,330,294 | A | 7/1994 | Gueson | |
| 5,639,187 | A | 6/1997 | Mungall et al. | |
| 5,855,178 | A | 1/1999 | Treu et al. | |
| 6,082,391 | A | 7/2000 | Thiebaud et al. | |
| 6,109,989 | A | 8/2000 | Kelm et al. | |
| 6,267,537 | B1 | 7/2001 | Breivik et al. | |
| 6,461,083 | B1 | 10/2002 | Pionetti et al. | |
| 6,595,725 | B1 * | 7/2003 | Shotbolt | 405/224.2 |
| 6,837,311 | B1 | 1/2005 | Sele | |
| 6,854,930 | B2 | 2/2005 | Pionetti | |
| 7,073,593 | B2 * | 7/2006 | Hatton et al. | 166/367 |
| 7,100,694 | B2 | 9/2006 | Legras et al. | |
| 7,104,330 | B2 * | 9/2006 | Legras et al. | 166/367 |
| 7,434,624 | B2 | 10/2008 | Wilson | |
| 7,793,726 | B2 * | 9/2010 | Daniel et al. | 166/367 |
| 8,186,912 | B2 * | 5/2012 | Saint-Marcoux et al. | 405/224.2 |
| 2004/0028479 | A1 | 2/2004 | Horton, III | |
| 2004/0129425 | A1 * | 7/2004 | Wilson | 166/359 |
| 2004/0218981 | A1 * | 11/2004 | Chenin | 405/169 |
| 2005/0063788 | A1 | 3/2005 | Clausen | |
| 2006/0000615 | A1 | 1/2006 | Choi | |
| 2008/0311804 | A1 | 12/2008 | Bauduin | |
| 2010/0172699 | A1 | 7/2010 | Saint-Marcoux | |

FOREIGN PATENT DOCUMENTS

| | | |
|---|---|---|
| WO | 2008056185 | 5/2008 |
| WO | 2009/012196 | 8/2009 |
| WO | 2010/035248 | 4/2010 |
| WO | 2010/041229 | 4/2010 |

* cited by examiner

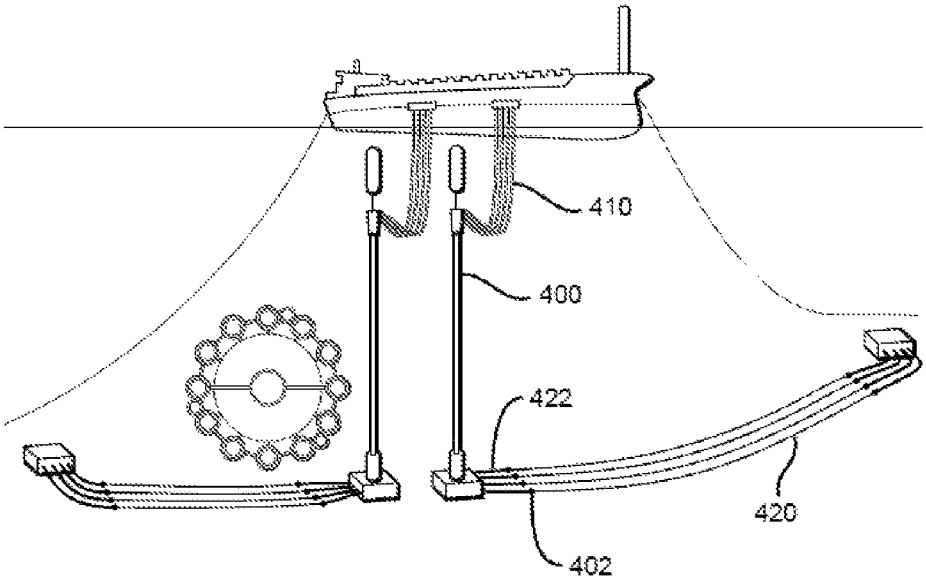
FIG. 4
FIG. 5
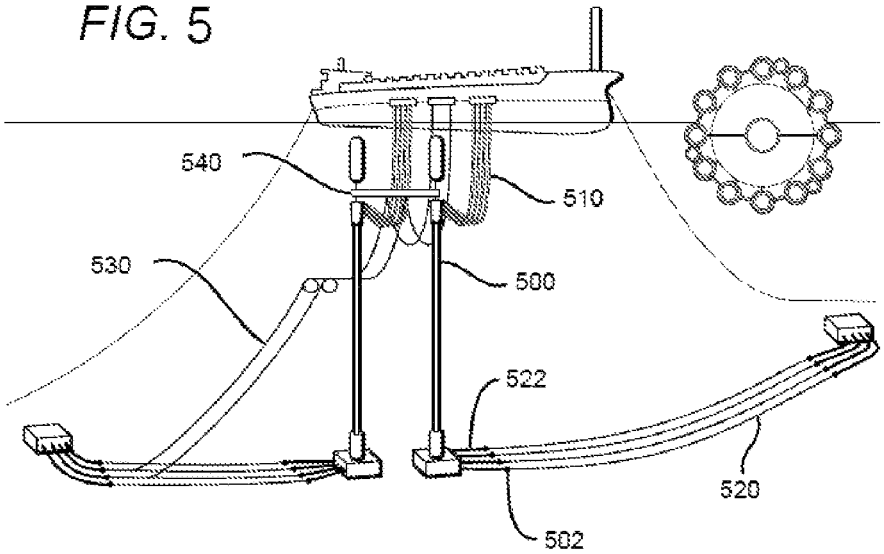

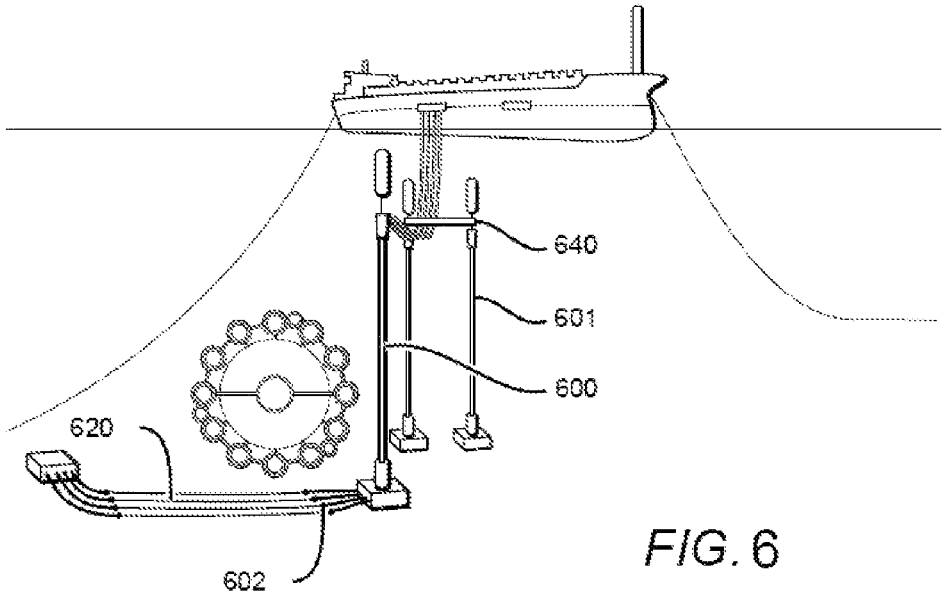
FIG. 6
FIG. 7
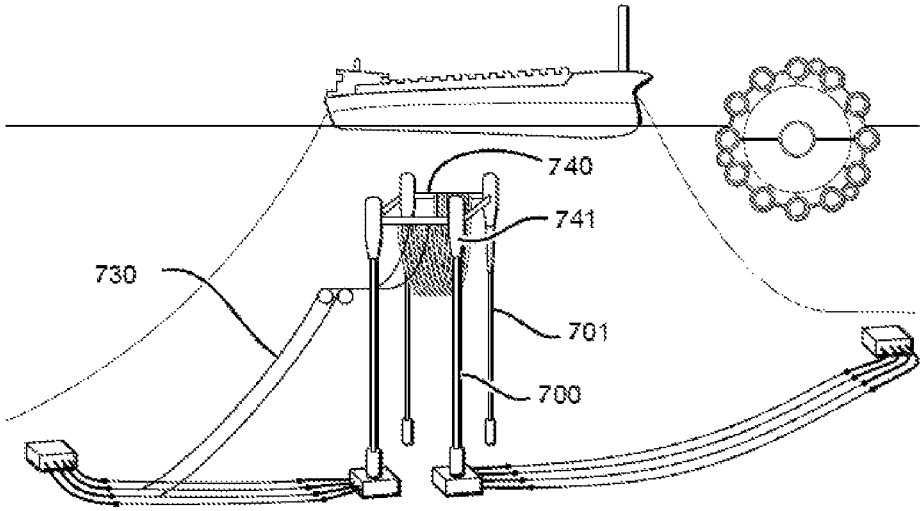

HYBRID BUOYED AND STAYED TOWERS AND RISERS FOR DEEPWATER

This application claims priority to our U.S. provisional application with the Ser. No. 61/253,765, which was filed Oct. 21, 2009.

FIELD OF THE INVENTION

The field of the invention is various configurations and methods for hybrid towers, and especially for buoyed and stayed tower and riser assemblies.

BACKGROUND OF THE INVENTION

Numerous marine riser towers are known in the art, and exemplary hybrid towers and configurations are described in, for example, U.S. Pat. Nos. 6,082,391, 6,461,083, 6,837,311, 7,100,694, U.S. Pat. App. No. 2010/0172699, WO 2010/035248 and WO 2010/041229. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

While most of the known hybrid towers can be manufactured and operated without significant challenges in offshore reservoirs at relatively shallow depth, thermal insulation, structural integrity, and weight control for hybrid towers for use at significant depth present substantial challenges. Additionally, as more reservoirs are found that produce corrosive product, solutions are needed to address the significant corrosion issues that occur within the flowlines and risers. Therefore, maintenance, repair and/or expansion of the flowlines and risers in the deepwater field developments has become increasingly important to extend the production life of the fields.

For example, to assist in the delivery of deepwater oil and gas to an offshore floating production and storage vessel (FPSO), flowline risers connect the floating vessel at the sea surface with the pipelines on the sea bed. However, such connection is not trivial, particularly where the offshore field is at a significant depth below sea level. Among other difficulties, most of the currently known structures negatively impact operational flexibility. For example, addition and/or removal, or maintenance of the flowline risers often interrupts continuous product flow. Similarly, where expansion of production capacity is desired, simple addition of new risers to existing structures is generally not possible in a cost-effective manner.

Thus, even though numerous methods and systems are known to convey gas and/or oil from a deep sea location to an offshore floating production and storage vessel or other receiving structure, various problems nevertheless remain. Consequently, there is still a need to provide configurations and methods for towers and risers.

SUMMARY OF THE INVENTION

The present invention is directed to hybrid riser tower configurations and methods that not only allow for simplified construction and installation, but also provide flexibility once installed. Moreover, contemplated towers can be coupled to each other via a structural truss or other static element to form operational structures with minimal impact on the marine environment.

In one aspect of the inventive subject matter, a hybrid buoyed and stayed tower and riser assembly comprises a support structure, and a plurality of dividers that are coupled to and radially extend from the support structure. Most typically, a plurality of riser lines is coupled to at least one of the plurality of dividers via a coupling element, and a plurality of isolation valves are fluidly coupled to the plurality of riser lines, respectively, and configured to allow isolation of each individual riser within the tower and riser assembly. In such assemblies, it is further particularly preferred that the coupling element and at least one of the dividers allows addition and/or removal of one or more riser lines by a remotely operated vehicle.

In still further particularly preferred aspects, a riser line includes a riser pipe that is contained in a housing, wherein the riser pipe and/or the housing is isolated by syntactic foam, and wherein the syntactic foam is applied in an amount effective to provide buoyancy to the at least one of the riser line. Alternatively, or additionally, the support structure comprises a structural steel tube, wherein the support structure is at least partially enclosed by syntactic foam. Most typically, the tower and riser assembly comprises a topside element having dynamic flexible jumpers and/or a bottom element having static flexible jumpers.

It is still further contemplated that two or more hybrid buoyed and stayed tower and riser assemblies are coupled to each other, preferably via a structural truss. The truss may be used in various functions, and most preferably to couple one or more steel catenary risers to the structural truss. Alternatively, or additionally, one or more buoyed and stayed towers may be coupled to the assembly, preferably via a riser porch (that may allow for wet storage of flexible risers).

In another aspect of the inventive subject matter, a method of modifying a hybrid buoyed and stayed tower and riser assembly may include a step of providing a support structure and a plurality of dividers that are coupled to and radially extend from the support structure. In another step, a riser line is coupled to or removed from one or more dividers via a coupling element using a remote operable vehicle, a plurality of isolation valves are coupled to or uncoupled from the riser line using the remote operable vehicle to thereby fluidly couple or isolate a topside jumper and a bottom jumper to or from the riser line.

Most preferably, the riser line comprises a riser pipe that is contained in a housing, wherein at least one of the riser pipe and the housing is isolated by syntactic foam, and wherein the syntactic foam is applied in an amount effective to provide buoyancy to the riser line. Furthermore, it is typically preferred that the support structure comprises a structural steel tube, and that the support structure is at least partially enclosed by syntactic foam.

In still further contemplated aspects, the hybrid buoyed and stayed tower and riser assembly is coupled to a second hybrid buoyed and stayed tower and riser assembly or to a buoyed and stayed tower, preferably via a structural truss. Where desired, a steel catenary riser may be coupled to the structural truss. Alternatively, or additionally, the structural truss is configured to allow for wet storage of flexible risers.

Therefore, in a further aspect of the inventive subject matter, a structural truss is configured for coupling a first hybrid buoyed and stayed tower and riser assembly or buoyed and stayed tower to a second hybrid buoyed and stayed tower and riser assembly or buoyed and stayed tower, and is further configured to allow the truss to act as a riser porch, or to receive and maintain a steel catenary riser and/or flexible jumper. Where the first and second towers are coupled to buoyancy elements via respective tethers, it is typically preferred that the truss is coupled to the tethers.

Various objects, features, aspects and advantages of the present invention will become more apparent from the following detailed description of preferred embodiments of the invention.

BRIEF DESCRIPTION OF THE DRAWING

FIGS. 4A-4D are schematic illustrations of exemplary hybrid riser configurations according to the inventive subject matter.

DETAILED DESCRIPTION

The inventor has discovered that a hybrid riser tower can be configured such that all or almost all of the disadvantages of heretofore known systems and methods can be overcome in a conceptually simple and effective manner in which multiple riser lines are coupled to a hybrid riser tower via divider, wherein the coupling elements are configured to allow coupling and uncoupling operation using a remote operated vehicle under water.

Additional advantages can be achieved by fluidly coupling isolation valves such that individual riser lines can be fluidly isolated. Among other advantages, such configurations will allow addition, removal, and/or replacement of one or more riser lines that are contained within a single deepwater hybrid riser tower without affecting operations during production. Moreover, contemplated hybrid riser towers may further be coupled with at least one other hybrid riser tower or stayed and buoyed tower, preferably, via a truss to reduce adverse effects of unintended movement and to further provide for expansion capabilities as the truss may be configured as a riser porch and/or to allow for coupling a SCR to the truss.

Figure 1A:
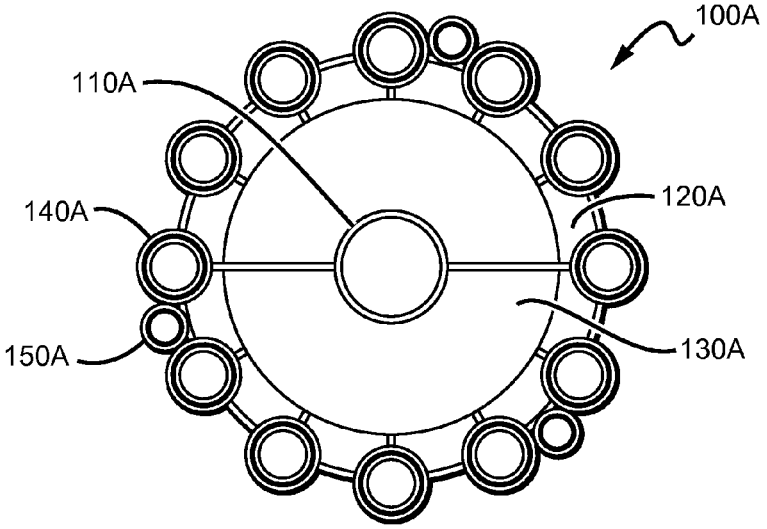
FIG. 1A is a cross section of a first exemplary hybrid riser according to the inventive subject matter
Figure 1B:
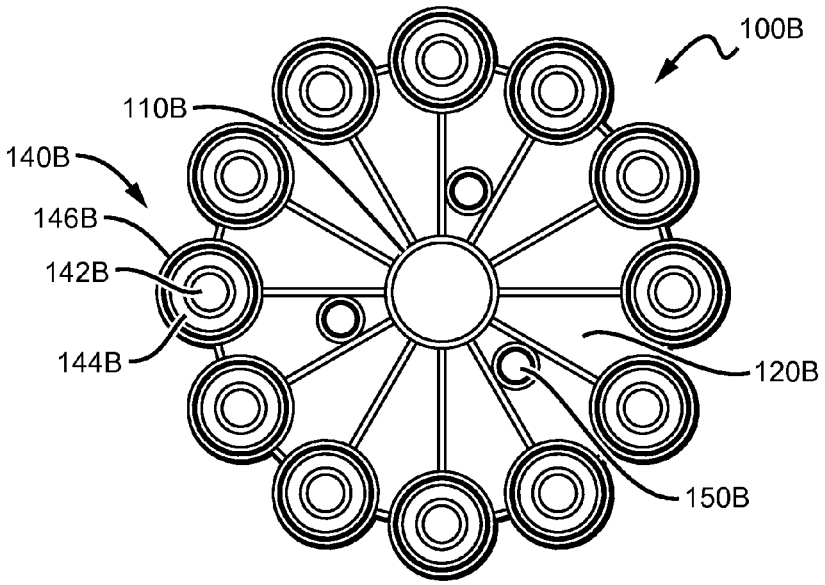
FIG. 1B is a cross section of a second exemplary hybrid riser according to the inventive subject matter.

In one exemplary aspect of the inventive subject matter as schematically illustrated in FIG. 1A, a hybrid riser tower 100A comprises a structural steel tube as a typically central support structure 110A. Coupled to the support structure 110A (typically in regular intervals) are a plurality of radially extending dividers 120A, which may be configured to provide additional structural stability to the hybrid riser tower. Contemplated dividers are configured to receive at least a portion of riser line 140A such that the riser line can be affixed to the divider 120A using coupling elements (see FIGS. 2A and 2B) via an ROV. The riser line may be enclosed in a housing (not shown) similar as depicted in FIG. 1B below. Most preferably, the riser lines are circumferentially coupled to the support structure and divider in equidistant positions, and additional lines (e.g., umbilicals 150A) may also be coupled to the divider in a peripheral position for remote addition and/or removal. Buoyancy of the hybrid riser tower is preferably achieved at least in part via syntactic foam layers 130A that surround the support structure between the dividers. Of course, it should be appreciated that additional buoyancy can be achieved using various gases in buoyancy chambers as is known in the art.

In another exemplary aspect of the inventive subject matter as schematically illustrated in FIG. 1B, a hybrid riser tower 100B comprises a structural steel tube as a typically central support structure 110B. Coupled to the support structure 110B (typically in regular intervals) are a plurality of radially extending dividers 120B, which may be configured to provide additional structural stability to the hybrid riser tower. Contemplated dividers 120B are configured to receive at least a portion of riser line 140B in a manner similar to FIG. 1A above. However, in the example of FIG. 1B, the riser line is formed from a housing 146B that surrounds syntactic foam 144B, which in turn at least partially encloses riser pipe 142B. Additional lines (e.g., umbilicals 150B) may then be routed through the divider or circumferentially as depicted in FIG. 1A above.

Figure 2B:
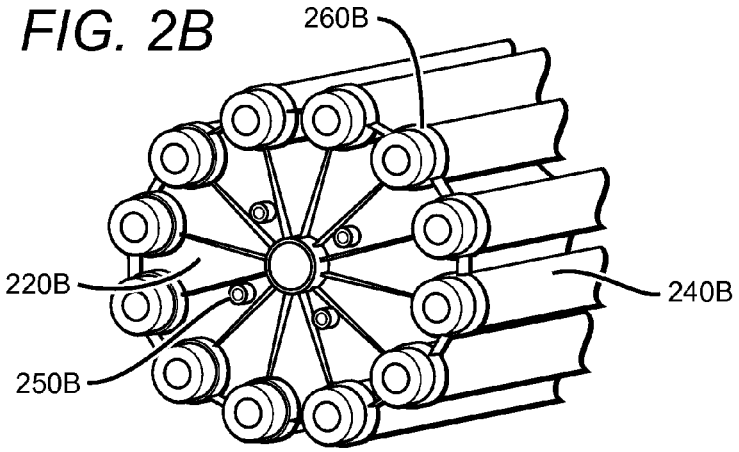
FIGS. 2A and 2B are perspective detail views of the hybrid riser of FIG. 1B.
Figure 2A:
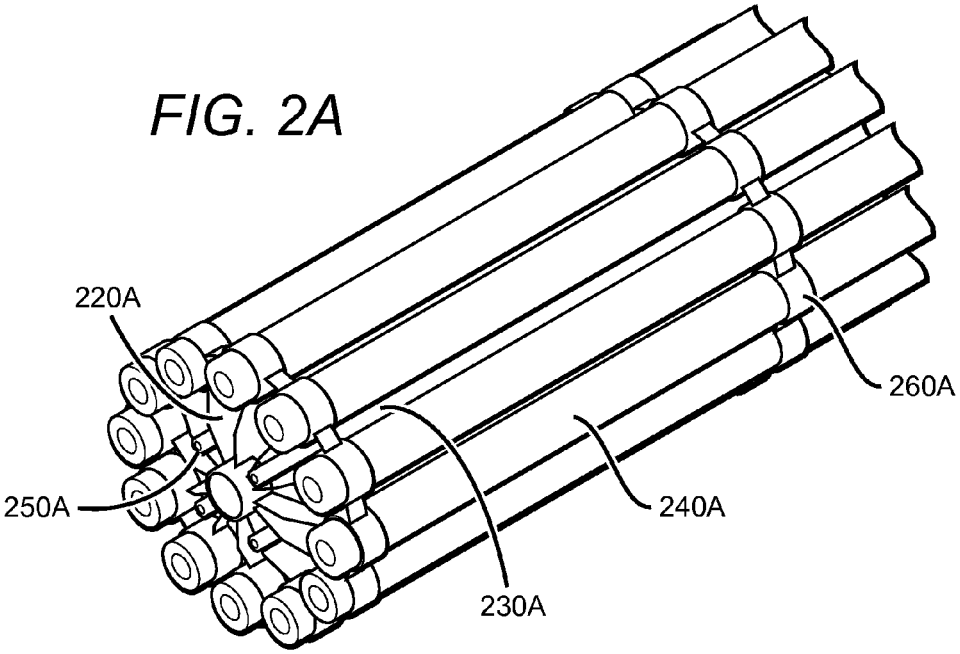

FIG. 2A schematically illustrates a detail view of an hybrid riser tower where the riser lines are contained in a housing with syntactic foam. Here, coupling elements 260A cooperate with the dividers 220A to retain the riser line 240A on the hybrid riser tower. To add further buoyancy, additional syntactic foam 230A may be added to surround the central support structure. Additional lines 250A are routed through dividers 220A. FIG. 2B is a detail view of FIG. 2A where coupling element 260B cooperates with a portion of the divider 220B to retain riser line 240B. Additional umbilical lines 250B are routed through divider 220B.

Therefore, it should be recognized that the hybrid riser tower contemplated herein can be locally and substantially completely fabricated to form a free-standing hybrid riser tower that can be transported and installed using conventional offshore anchor handling and tow vessels. Moreover, contemplated configurations and methods presented herein allow multiple small risers from multiple reservoirs to be installed in one fabricated unit and so lower the overall cost per riser by taking advantage of the economies of scale. As a further advantage of the construction of the hybrid riser tower presented herein, it is now also possible to add, remove, and/or replace riser lines that are contained within a single deepwater hybrid riser tower without affecting operations during production. Most typically, such advantage is achieved by a series of isolation valves on the tower and/or at the jumpers that isolate each individual riser line within the single tower. Conventional release clamps and release mechanisms are provided to so allow release of the riser line by remote intervention from an ROV (remote operated vehicle) working underwater. It should still further be appreciated that recovery and replacement of individual riser lines is also now possible by control of the riser line buoyancy using syntactic foam and air to provide positive buoyancy of each riser line. Thus, it should be noted that conventional lower-cost offshore installation vessels such as an anchor handling and tow vessels may be used for recovery and replacement of riser lines.

Figure 3B:
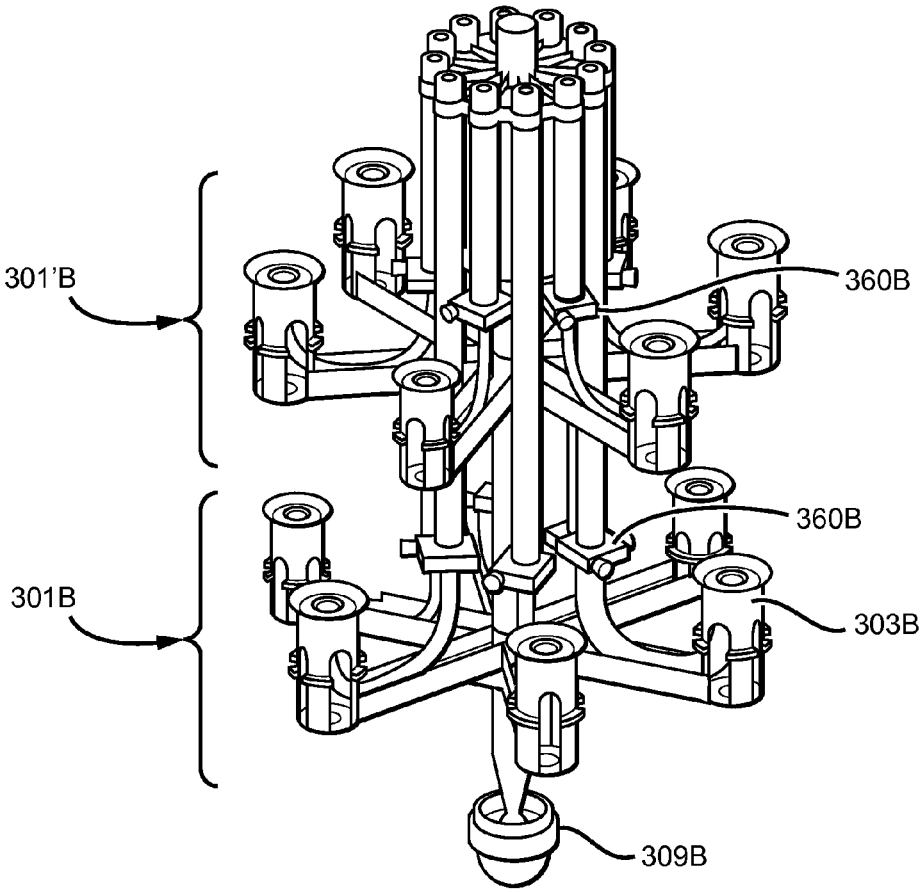
FIGS. 3A and 3B are perspective detail views of exemplary top and bottom elements of hybrid risers according to the inventive subject matter.
Figure 3A:
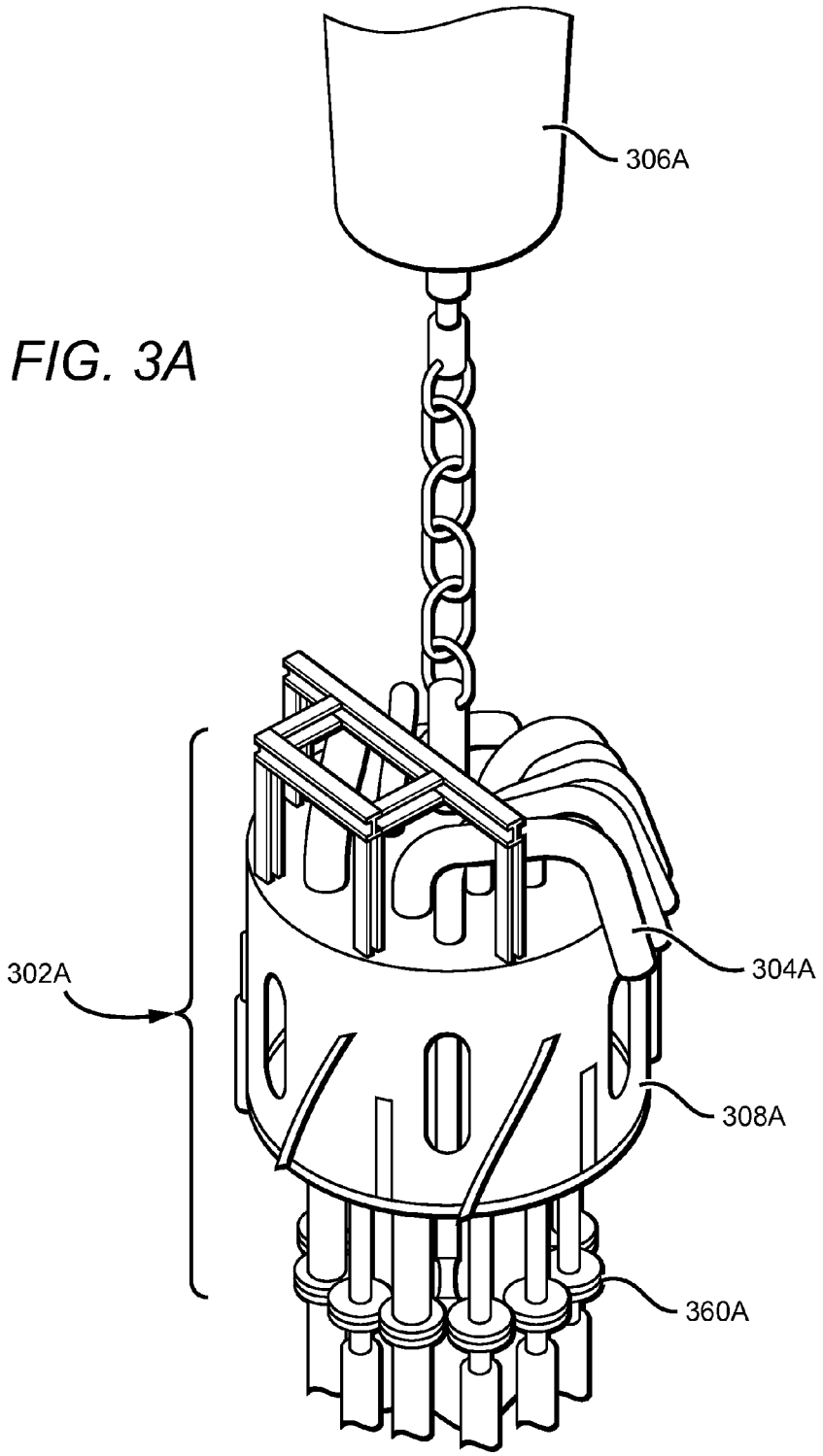

Exemplary aspects of top and bottom elements of an hybrid riser tower assembly are schematically depicted in FIGS. 3A and 3B. In FIG. 3A, the top element 302A is coupled to a buoyancy can 306A, typically via a chain or other flexible structure, and fluidly coupled to the support structure and riser lines below via ROV operable coupling elements 360A. Shroud 308A covers fluid connectors between the riser lines and the ports for the dynamic flexible jumpers, and isolation valve 304A is coupled to the ports. Alternatively, the isolation valve may also be downstream of the port, e.g., at the topside or end of the dynamic flexible jumper. FIG. 3B depicts an exemplary bottom element having two independent portions 301B and 301'B. Similar to the top element, the individual riser lines are coupled to the bottom element via ROV operable coupling elements 360B, and static flexible jumpers are attached to the respective ports and isolation valves 303B. As before, it should be appreciated that the isolation valves may also be placed at a position other than the bottom element, for example, at the other end of the static flexible jumpers or a position upstream thereof. Most typically, the bottom element will also include a connector for anchoring the hybrid riser tower (here: roto-latch connector 309B).

It should still further be appreciated that a single hybrid riser tower or multiple hybrid riser towers allow the motions of the FPSO to be de-coupled from the risers themselves by removing the large weight that would be supported by the FPSO if such towers were not available. In most preferred aspects, flexible dynamic risers connect the free standing riser tower to the FPSO, and the flexible dynamic risers can be removed from the FPSO in an emergency (e.g., storm) and stored on a subsea structural porch that is preferably created by coupling two or more free standing hybrid riser towers together with a structural truss or frame, or by coupling two free standing buoyed and stayed riser towers. As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Therefore, and viewed from another perspective it should be appreciated that the buoyed and stayed towers and risers presented herein will offer a unique solution with the addition of a cross-braced truss or other structure that couples two riser towers together to form a platform upon which steel catenary risers may be added to expand the offshore field development at a significantly smaller incremental cost than providing a stand alone riser since the platform already exists for expansion. Various exemplary configurations are schematically depicted in FIGS. 4-7.

FIG. 4 shows a hybrid riser tower 400 that receives product from a plurality of production lines 420, wherein each production line has a respective isolation valve 402 and wherein each production line is fluidly coupled to respective static flexible jumpers 422 that are in turn fluidly coupled to respective riser lines in the hybrid riser tower. Product is then conveyed from the hybrid riser tower to the FPSO via respective dynamic flexible jumpers 410. Capacity expansion of such configuration can be achieved as exemplarily shown in FIG. 5, where two hybrid riser towers 500 are coupled to each other via a structural truss 540. As before, hybrid riser towers 500 receive product from a plurality of production lines 520, wherein each production line has a respective isolation valve 502 and wherein each production line is fluidly coupled to respective static flexible jumpers 522 that are in turn fluidly coupled to respective riser lines in the hybrid riser tower. Product is then conveyed from the hybrid riser tower to the FPSO via respective dynamic flexible jumpers 510.

Additionally, steel catenary riser 530 is coupled to the truss 540 in a lazy wave configuration and also provides product to the FPSO.

Where wet storage of the dynamic flexible jumpers is anticipated, configurations as exemplarily depicted in FIG. 6 are contemplated. Here, two stayed buoyed towers 601 are coupled to each other via a structural truss 640 that is configured as a riser porch upon which the dynamic flexible jumpers can be stored. Jumpers originate from hybrid riser tower 600, which receives product via individual riser lines that are fluidly isolated from production lines 620 via isolation valves 602.

In still further contemplated aspects of the inventive subject matter as exemplarily shown in FIG. 7, two hybrid riser towers 700 are coupled to each other via a structural element and further coupled via structural elements 741 to two stayed buoyed towers 701, which are also coupled to each other via truss 740. As before, it should be appreciated that the truss and/or other structural element may be used as a riser porch, as a carrier for steel catenary risers 730, and/or as reinforcing mechanism to reduce inadvertent contact and flexing of the hybrid riser towers beyond a desired degree.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A hybrid buoyed and stayed tower and riser assembly, comprising:

a support structure, and a plurality of dividers that are coupled to and radially extend from the support structure;

a plurality of riser lines coupled to at least one of the plurality of dividers via a coupling element;

a plurality of isolation valves that are fluidly coupled to the plurality of riser lines, respectively, and configured to allow isolation of each individual riser within the tower and riser assembly; and wherein the coupling element and the at least one of the dividers is configured to allow addition and/or removal of at least one of the riser lines by a remotely operated vehicle.

2. The assembly of claim 1 wherein at least one of the riser lines comprises a riser pipe that is contained in a housing, wherein at least one of the riser pipe and the housing is isolated by syntactic foam, and wherein the syntactic foam is applied in an amount effective to provide buoyancy to the at least one of the riser line.

3. The assembly of claim 2 wherein the tower and riser assembly comprises at least one of a top element suitable for attachment of a dynamic flexible jumper and a bottom element suitable for attachment of a static flexible jumper.

4. The assembly of claim 2 further comprising a second hybrid buoyed and stayed tower and riser assembly, and a structural truss coupling the assemblies together.

5. The assembly of claim 4 further comprising a steel catenary riser coupled to the structural truss.

6. The assembly of claim 1 wherein the support structure comprises a structural steel tube, and wherein the support structure is at least partially enclosed by syntactic foam.

7. The assembly of claim 1 further comprising at least one buoyed and stayed tower coupled to a riser porch that is configured to allow wet storage of flexible risers.

8. The assembly of claim 7 wherein two buoyed and stayed towers are coupled to the riser porch.

9. A method of modifying a hybrid buoyed and stayed tower and riser assembly, comprising:

providing a support structure, and a plurality of dividers that are coupled to and radially extend from the support structure;

coupling or removing a riser line to at least one of the plurality of dividers via a coupling element using a remote operable vehicle; and coupling or uncoupling a plurality of isolation valves to the riser line using the remote operable vehicle to thereby fluidly couple or isolate a top jumper and a bottom jumper to or from the riser line, and wherein the plurality of isolation valves are configured to allow isolation of the riser line within the tower and riser assembly.

10. The method of claim 9 wherein the riser line comprises a riser pipe that is contained in a housing, wherein at least one of the riser pipe and the housing is isolated by syntactic foam, and wherein the syntactic foam is applied in an amount effective to provide buoyancy to the riser line.

11. The method of claim 9 wherein the support structure comprises a structural steel tube, and wherein the support structure is at least partially enclosed by syntactic foam.

12. The method of claim 9 further comprising a step of coupling the hybrid buoyed and stayed tower and riser assembly to a second hybrid buoyed and stayed tower and riser assembly or to a buoyed and stayed tower.

13. The method of claim 12 wherein the step of coupling comprises coupling the hybrid buoyed and stayed tower and riser assembly to the second hybrid buoyed and stayed tower and riser assembly or to the buoyed and stayed tower via a structural truss.

14. The method of claim 13 further comprising a step of coupling a steel catenary riser to the structural truss.

15. The method of claim 13 wherein the structural truss is configured to allow for wet storage of flexible risers.

* * * * *